US005534748A

United States Patent [19]

Oomen

[11] Patent Number: 5,534,748

[45] Date of Patent: Jul. 9, 1996

[54] DISPLAY DEVICE COMPRISING A DISPLAY SCREEN PROVIDED WITH A LIGHT ABSORBING COATING

[75] Inventor: Emmanuel W. J. L. Oomen, Eindhoven, Netherlands

[73] Assignee: U.S. Philips Corporation, New York, N.Y.

[21] Appl. No.: 395,949

[22] Filed: Feb. 28, 1995

[30] Foreign Application Priority Data

Mar. 3, 1994 [EP] European Pat. Off. ..... 94200541

[51] Int. Cl.[6] ..... H01J 29/89

[52] U.S. Cl. ..... 313/479; 313/478; 313/466; 313/474; 313/110; 445/58; 427/126.4; 427/126.1; 252/582

[58] Field of Search ..... 313/110, 117, 313/461, 466, 474, 479; 445/58; 427/58, 126.1, 126.4; 348/834, 835; 252/582, 584, 586

[56] References Cited

U.S. PATENT DOCUMENTS 4,745,327 5/1988 Saeki et al. ..... 313/112
4,987,338 1/1991 Itou et al. ..... 313/478
5,315,209 5/1994 Iwasaki et al. ..... 313/579

FOREIGN PATENT DOCUMENTS

0603941A1 6/1994 European Pat. Off. .

*Primary Examiner*—Nimeshkumar D. Patel
*Attorney, Agent, or Firm*—John C. Fox

[57] ABSTRACT

The display screen (3) of a cathode ray tube (1) is provided with a light-absorbing coating (8) comprising a hybrid inorganic-organic material consisting of an inorganic network of at least silicon oxide and a polymeric component. By means of a sol-gel process the coating can be provided in a relatively large thickness without causing crackles. Consequently, the layer can contain large quantities of dyestuff, so that said layer can very suitably be used as a chrominance or transmission coating to improve the picture contrast. Even if the display screen is not highly polished, the coating can be obtained with a high-polish and it complies with the customary mechanical, chemical and optical requirements.

13 Claims, 1 Drawing Sheet

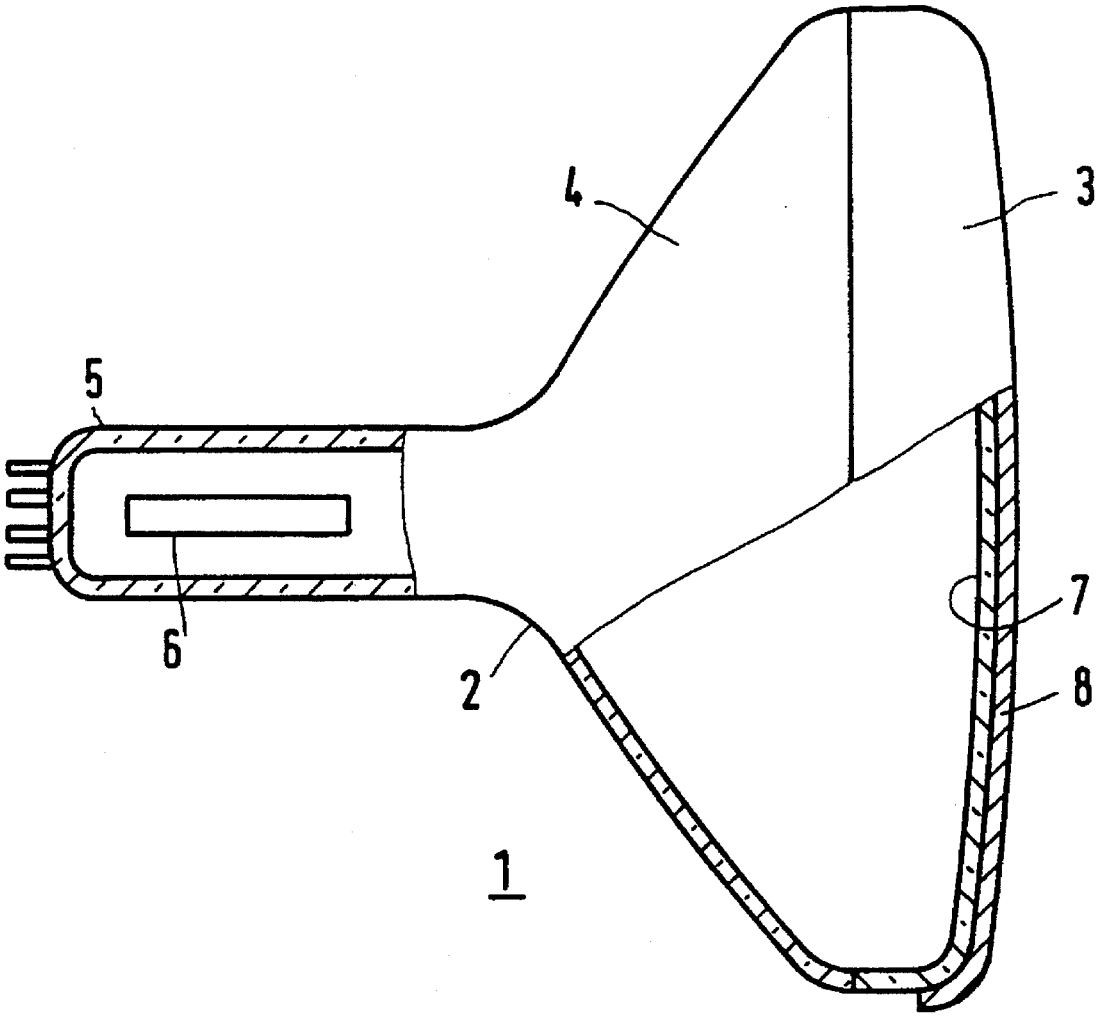
4
3
5
7
6
2
8
1

DISPLAY DEVICE COMPRISING A DISPLAY SCREEN PROVIDED WITH A LIGHT ABSORBING COATING

BACKGROUND OF THE INVENTION

The invention relates to a display device comprising a display screen which is provided with a light-absorbing coating of an inorganic network comprising at least silicon oxide and a dyestuff.

The invention also relates to a method of manufacturing a light-absorbing coating of an inorganic network comprising at least silicon oxide on a display screen of a display device by means of a sol-gel process, an aqueous solution of an alkoxysilane and a dyestuff being provided on the display screen and heated to convert the solution into said coating.

Light-absorbing coatings which are used to reduce the light transmission are applied to the face plates of display devices, such as cathode ray tubes (CRTs), liquid crystal display devices (LCD and LC-TV) and thin electron displays, to improve the contrast of the image reproduced. By virtue thereof, there is no necessity to change the glass composition of the display screen and the possibilities of bringing the light transmission to a desired value in a simple manner are increased. Such coatings reduce the transmission of both incident ambient light and light originating from CRT phosphors or colour filters. As the coatings can be provided in a uniform manner, the transmission of the filtering layers is also uniform. The incident ambient light passes through the coating and the glass display screen, after which it reflects off, respectively, the rough phosphor layer or the colour filter on the inside of the display screen and again passes through the display screen and the coating. If the transmission of the coating is designated T, the intensity of the reflected ambient light is reduced by a factor of $T^2$. Light originating from, respectively, the phosphors and the colour filter passes through the coating only once, so that the intensity of this light is reduced by a factor of T only, resulting in an increase of the contrast by a factor of T. There are transmission or T-coatings the absorption of which is substantially independent of the wavelength of the visible light and which, as a result, are of a neutral-grey colour, and chrominance or C-coatings which selectively absorb one or more spectral regions of the visible light. In the latter case, the absorption is preferably selected so that it takes place in the spectral region situated between the emission spectra of the phosphors.

In U.S. Pat. No. 4,987,338 a description is given of a cathode ray tube having a display screen which is provided with a coating comprising a silicon (di)oxide network and a dyestuff having a selective light absorption which is maximal in the wavelength range of 575±20 nm. Said Patent Specification also describes a method of manufacturing such a layer by means of a sol-gel process in which an aqueous alcoholic solution of an alkoxysilane compound, such as tetraethyl orthosilicate $Si(OC_2H_5)_4$ (TEOS), acidified with hydrochloric acid and to which a dyestuff is added, is spin coated onto a display screen. For example, Rhodamine B is used as the dyestuff. Silicon (di)oxide starts forming in the solution. By a treatment at an increased temperature, the formation of silicon (di)oxide is completed and a layer of a silicon (di)oxide network which also contains the dyestuff is formed.

In the non-prepublished European Patent Application EP-A-603941, filed by Applicants, a description is given of a method of manufacturing a neutral, absorbing coating of silicon oxide, metal oxide and a black dyestuff by means of a sol-gel process, said coating having an improved light fastness and chemical resistance.

A disadvantage of the known method is that the maximally attainable layer thickness of the sol-gel coating is 0.8 μm owing to the large quantities of water and alcohol to be evaporated, which leads to shrinkage during the curing operation. Due thereto, the risk of crackles in the layer increases as the layer thickness increases. The maximum concentration of dyestuff in a sol-gel layer is limited. Larger quantities of dyestuff cause the chemical resistance and the mechanical properties of the layer, such as hardness and resistance to wear, to be reduced. This is caused by the fact that the silicon-oxide network is disturbed, which has the additional disadvantage that the dyestuff can be washed out. Owing to the small layer thickness of the known sol-gel layers, the maximum quantity of dyestuff in the layer is limited, so that the maximally attainable light absorption of the layer is limited too. This can be compensated for by means of a second sol-gel layer comprising dyestuff. However, this requires an additional process step.

The known, relatively thin sol-gel layers additionally require a smooth, high-polish display-screen surface in order to obtain a coating having a high-polish surface. This means that the average roughness $R_a$ across the substrate surface must not exceed 0.05 μm and that the maximum roughness $R_z$ must not exceed 0.3 μm. For this purpose, the display-screen surface must be subjected to an expensive fine-polishing treatment, for example with $Ce_2O_3$.

OBJECTS AND SUMMARY OF THE INVENTION

It is an object of the invention to provide, inter alia, a display device comprising a display screen which is provided with a light-absorbing coating of an inorganic silicon-oxide network, which coating can be applied without inconvenience in a thickness in excess of 0.8 μm, so that the light absorption attained is higher than that of the known coatings while the concentration of dyestuff in the coating remains the same. The coating must adhere well to the glass display screen and it must be homogeneous and have good optical properties. The coating must also have good mechanical properties, such as a high hardness and a high resistance to wear. It must be possible to apply the coating by means of a sol-gel process. A further object of the invention is to provide a simple method of manufacturing such a coating on a display screen at relatively low temperatures at which no damage is caused to parts of the complete display device, such as a cathode ray tube. In addition, the method must be suitable for the manufacture of a coating which, if desired, can have a high-polish appearance which does not require a fine-polishing treatment of the display-screen surface.

The object of providing a display device comprising a display screen which is provided with a light-absorbing coating is achieved by a display device, as described in the opening paragraph, which is characterized in accordance with the invention in that a metal oxide of at least one metal selected from the group formed by Al, Ti, Zr and Ge is incorporated into the inorganic network of the coating, and in that the coating also comprises a carbon-containing polymer which is chemically bonded to and intertwined with the inorganic network via Si—C bonds.

The incorporation of an oxide of Al, Ti, Zr and Ge or a mixture of one or more of said metal oxides into the hybrid network of silicon oxide and polymers results in an improved resistance of the coating against leaching out of the dyestuff when the coating is brought into contact with cleaning liquids, such as ethanol, acetone, ammonia and soap solutions. By virtue of said metal oxides, the resistance of the coating against diluted acetic acid and salt water is also improved. The metal oxides also improve the mechanical properties of the coating, such as hardness, resistance to wear and scratch resistance. The coating comprises 1 to 50 mol %, preferably 5 to 35 mol %, of said metal oxide relative to silicon oxide. Below 1 mol %, the favourable effect occurs insufficiently, whereas above 50 mol %, there is no further improvement and the coating becomes unnecessarily expensive. Aluminium oxide is preferred to the other, above-mentioned metal oxides because incorporation of aluminium oxide leads to the best mechanical properties of the coating.

The coating in accordance with the invention is a hybrid inorganic-organic material which comprises a polymeric component in addition to the inorganic network of silicon oxide and metal oxide. In said hybrid material, certain C-atoms of the polymer are chemically bonded to Si atoms of the inorganic network. The polymeric chains are intertwined with the inorganic network, thereby forming a hybrid inorganic-organic network. The chemical bond between the polymeric component and the inorganic network results in coatings which are mechanically strong and thermally stable. By virtue of the polymeric component in the silicon-oxide network, thick coatings up to 100 μm can be manufactured without causing cracks (crackles) in the layer. The bonding between the coating and the glass surfaces is very good.

Examples of polymeric components are polyether, polyacrylate and polyvinyl.

Coatings having thicknesses of from 0.5 to 10 μm are manufactured for display screens. In such relatively thick layers, a relatively large quantity of dyestuff can be dissolved or incorporated, resulting in a low transmission of the layers and hence a high contrast of the image reproduced. In addition, if such relatively thick coatings are used, it is not necessary to subject the glass surface of the display screen to a time-consuming fine-polishing treatment with, for example, $Ce_2O_3$. Rough-polishing of the glass surface with pumice powder to an average roughness ($R_a$) of 0.13 μm and an $R_z$ value of 1.6 μm yields, in combination with an inventive coating having a thickness of, for example, 2 μm, a high-polish, smooth surface. To obtain an optimum effect, the refractive index of the coating can be adapted to that of the glass of the display screen. The refractive index of the coating can be varied between 1.45 and 1.60. An increase of the concentration of metal oxides in the coating leads to an increase of the refractive index, whereas an increase of the quantity of polymeric component causes the refractive index of the coating to decrease.

The coating in accordance with the invention comprises one or more dyestuffs. Both inorganic pigments and organic dyestuffs are possible. Examples thereof are xanthenes, such as Rhodamine B (Colour Index 45170), phthalocyanines and azo-dyes. Rhodamine B is used to increase the contrast of the display screen, but it gives the coating a violet appearance, which is not always desirable. This can be corrected by adding one or more dyestuffs of a different colour to the coating.

Usually, a neutral grey to black appearance of the coating is desired. For this purpose, a black dyestuff can be used in the coating. A large number of known black dyestuffs are unsuitable because they cannot be dissolved in the sol-gel coating solution to be used. Black dyestuffs which can suitably be used in the coating in accordance with the invention are, inter alia, Orasol Black CN™ (Colour Index: Solvent Black 28) and Orasol Black RL™ (Colour Index: Solvent Black 29) by Ciba Geigy; Zapon Black X51™ (Colour Index: Solvent Black 27) by BASF and Lampronol Black™ (Colour Index: Solvent Black 35) by ICI. These dyestuffs enable high-polish black coatings to be manufactured. A dyestuff which is very suitable is Orasol Black CN™ (Colour Index: Solvent Black 28) because it exhibits a high light fastness. The chemical structural formula of the latter dyestuff is unknown; according to the supplier it is a mono-azo chromium complex. In the wavelength range between 410 and 680 nm, the transmission of the filtering layer comprising Orasol Black CN™ is substantially constant and hence spectrally neutral. Dependent upon the transmission desired, the coating comprises more or less dyestuff or the layer thickness is varied.

If desired, the coating can be provided with anti-static properties by incorporating conductive particles, such as tin-oxide particles which may or may not be doped with Sb or In, conductive ions such as $Li^+$ or conductive polymers, such as polypyrrole.

The object of providing a simple method of manufacturing a light-absorbing coating of an inorganic network of at least silicon oxide on a display screen of a display device is achieved by a method as described in the opening paragraph, in which the coating is manufactured by providing an aqueous solution of an alkoxysilane and a dyestuff, which solution is subsequently converted to the coating in a sol-gel process, said method in accordance with the invention being characterized in that the solution comprises a mixture of a trialkoxysilane of the formula:

$$(RO)_3Si—R^1$$

wherein R is an alkyl group and $R^1$ is a polymerizable group, and $R^1$ is chemically bonded to the Si-atom via an Si—C bond, an alkoxy compound of at least one metal selected from the group formed by Al, Ti, Zr and Ge, and the dyestuff, the thermal treatment being carried out to form the dyestuff-containing coating from the inorganic network of silicon oxide comprising an oxide of the metal and a polymer which is formed from the polymerizable group $R^1$, which polymer is chemically bonded to and intertwined with the inorganic network via Si—C bonds.

The sol-gel process is based on the homogeneous hydrolysis and polycondensation of silicon alkoxides and metal alkoxides in the presence of water. A three-dimensional, inorganic network is formed by using trialkoxysilanes and said metal alkoxides. The R-group is preferably a $C_1$–$C_5$ alkyl group. The trialkoxysilane comprises a polymerizable $R^1$-group which is chemically bonded to the Si-atom via an Si—C bond. Examples of suitable polymerizable $R^1$-groups are the epoxy, methacryloxy and vinyl groups. Suitable examples of trialkoxysilanes comprising polymerizable $R^1$-groups are: 3 -glycidoxypropyl-trimethoxysilane, 3-methacryloxypropyl-tri methoxysilane and vinyltriethoxysilane. During the sol-gel process, the alkoxysilanes and metal alkoxides hydrolyse and condense to form an inorganic network of silicon oxide and metal oxide, the polymerizable groups forming polymeric chains which are chemically bonded to the inorganic network via Si—C bonds. The epoxy groups, methacryloxy groups and vinyl groups polymerize, respectively, into a polyether, a polymethacrylate and a polyvinyl. The epoxy groups can be thermally polymerized, for which purpose an amine compound may optionally be added to the solution as a catalyst. Polymerization of the other groups requires the layer to be exposed to UV light. The polymeric chains are chemically bonded to and intertwined with the inorganic network. This results in mechanically strong and thermally stable coatings. The organic polymer provides the hybrid material with a large tensile strength, a high modulus of elasticity and a high impact resistance, while the three-dimensional inorganic network of silicon oxides and the above-mentioned metal oxides provide the material with a high hardness, a high scratch resistance and a large compressive strength. The solution comprises 20 to 99 mol %, preferably 30 to 80 mol %, trialkoxysilane with a polymerizable group relative to the other alkoxy compounds.

For the metal-alkoxy compounds use is made of compounds of the formula: $M(OR)_n$, wherein M=Al, Ti, Zr or Ge; R is a $C_1$–$C_5$ alkyl group and n is the valency of the metal M. Examples of suitable metal-alkoxy compounds are:

tetraethoxy-germanate $Ge(OC_2H_5)_4$ (TEOG),
tetrabutoxy-zirconate $Zr(OC_4H_9)_4$ (TBOZ),
tetrapropoxy-zirconate $Zr(OC_3H_7)_4$ (TPOZ),
tripropoxy-aluminate $Al(OC_3H_7)_3$ (TPOAl),
tributoxy-aluminate $Al(OC_4H_9)_3$ (TBOAl) and
tetraethoxy-titanate $Ti(OC_2H_5)_4$ (TEOTi).

The solution comprises 1 to 50 mol %, preferably 5 to 35 mol %, of the metal-alkoxy compound relative to the other alkoxy compounds. Hydrolysis and condensation cause the corresponding metal oxide to be incorporated into the inorganic network. By virtue thereof, the above-mentioned advantages as regards chemical resistance and light fastness of the coating are achieved. In addition, the stability of the solution is improved by adding said metal-alkoxy compounds, in particular trialkoxyaluminate.

The solution may also comprise 0.01 to 10 mol % of an aminoalkoxysilane, such as 3-aminopropyl-triethoxysilane, or other amine compounds, such as trimethylamine, relative to the alkoxy compounds. These amine compounds serve as a catalyst for the thermal polymerization of the epoxy groups.

One or more of the above-mentioned dyestuffs which can be dissolved in the solution, such as the lightfast, black dyestuff Orasol Black CN™ (Colour Index: Solvent Black 28), can be used as the dyestuff.

The coating can optionally be rendered anti-static by adding the above-mentioned conductive components to the solution.

In addition to water for the hydrolysis reaction, the solution comprises one or more organic solvents, such as ethanol, butanol, isopropanol and diacetone alcohol.

The solution can be customarily provided on the display screen, for example, by means of spraying or atomizing. The alcoholic solution is preferably spin coated onto the display screen. After drying and heating to, for example, 160° C. for 30 minutes, a mechanically strong, smooth and high-polish filtering layer having the desired electrical and light-absorbing properties is obtained.

The formation of a homogeneous, smooth layer can be promoted by adding a surface-active substance to the solution, for example in quantities of from 0.01 to 5 wt. %. By virtue of the relatively mild reaction temperature, curing of the layer can take place on the display screen of a complete display device.

The formed coating of a hybrid, inorganic-organic material can be much thicker than 1 μm, for example up to 100 μm without causing crackles in the layer. After such a coating is spun in a thickness of 2 μm onto rough, glass surfaces having an average roughness ($R_a$) of, for example, 0.13 μm, said surfaces obtain a smooth, polished appearance. By virtue thereof, an additional fine-polishing treatment of the surface of the glass screen can be dispensed with.

To improve the chemical resistance of the coating, optionally up to 40 mol % of alkyl trialkoxysilane or aryl trialkoxysilane relative to the other alkoxy compounds is added to the coating solution. This addition causes the coating to become more hydrophobic. In this case, the alkoxy groups and the alkyl group comprise 1 to 5 C-atoms. An example of a suitable aryl trialkoxysilane is phenyl-trimethoxysilane. The alkyl and phenyl groups cannot be polymerized.

If desired, a small quantity of a fluorocarbon silane or a silane with another hydrophobic group, such as a hydrocarbon or phenyl group, can be added to the coating solution. The addition of only 0.1 to 1 mol % of a fluorocarbon silane relative to the other alkoxy compounds is sufficient to produce a hydrophobic coating. Owing to the apolar character of the fluorocarbon chain, the fluorocarbon silane settles selectively at the surface of the coating, thereby forming a very thin hydrophobic top coating. This thin top coating has no optical effect. It causes the coating to become water-repellent, so that the dyestuffs can no longer be washed out with aqueous solvents. In addition, visible finger prints can more easily be removed from the coating. A suitable fluorocarbon silane is, for example, $C_6F_{13}CH_2CH_2$—$Si(OC_2H_5)_3$. After the sol-gel process, the fluorocarbon chain is chemically bonded to the inorganic network.

A small part of all of the above-mentioned trialkoxysilane compounds can optionally be replaced by the corresponding dialkoxysilane compounds. Dialkoxysilane compounds do not intrinsically lead to a three-dimensional network, but to linear polysiloxane chains. This will lead to a slight reduction of the hardness of the coating.

In a preferred embodiment of the method in accordance with the invention, the coating solution comprises the following constituents:

alkoxy compounds in the following molar percentages:
- 40 to 90 mol % 3-glycidoxypropyl-trimethoxysilane
- 5 to 35 mol % tributoxy-aluminate
- 0.01 to 10 mol % 3-aminopropyl-triethoxysilane
- 0 to 30 mol % phenyl-trimethoxysilane 1 to 10 wt. % of the black dyestuff with Colour Index Solvent Black 28 an organic solvent water.

It is alternatively possible to apply the coating to a transparent front plate instead of to the display screen itself. This front plate does not have to be made of glass, but can alternatively be made, for example, of polycarbonate. The coating then also enables the desired scratch resistance to be achieved.

BRIEF DESCRIPTION OF THE DRAWINGS

The invention will be explained in greater detail by means of exemplary embodiments and a drawing, in which the sole FIGURE is a partly cut-away view of an embodiment of a cathode ray tube in accordance with the invention.

DESCRIPTION OF THE PREFERRED EMBODIMENTS

Exemplary embodiment 1.

A quantity of 40 g tributoxy-aluminate is dissolved in 48 g isopropanol to which 21 g ethyl-acetoacetate is added as the complexing agent. This solution is added to a mixture of the following silanes:

16 g phenyl-trimethoxysilane 120 g 3-glycidoxypropyl-trimethoxysilane 9 g 3-aminopropyl-triethoxysilane Subsequently, 100 g isopropanol and 100 g diacetone alcohol are admixed. The mixture is then hydrolysed by adding water step-by-step until the stoichiometric quantity of water has been added; meanwhile the mixture is cooled by means of an ice bath. After all the water has been added, the solution is stirred at room temperature for 2 hours. Subsequently, the dyestuff Orasol Black CN™ (Colour Index: Solvent Black 28) is added in a concentration of 6 g per kilogram of liquid, whereafter the solution is filtrated.

The solution obtained comprises alkoxy compounds in the following molar percentages:

10 mol % phenyl-trimethoxysilane 65 mol % 3-glycidoxypropyl-trimethoxysilane 5 mol % 3-aminopropyl-triethoxysilane 20 mol % tributoxy-aluminate.

The solution obtained is subsequently spin coated onto a flat display screen at a rate of 200 r.p.m., whereafter it is cured for 1 hour at 160° C. The coating obtained has a thickness of 4 μm. Said high-polish, neutral-black coating exhibits an average transmission of 20±2% between 420 and 680 nm.

The thickness of the filtering layer obtained is governed, inter alia, by the quantity of solvent and the number of revolutions during spin coating of the layer.

The coating is resistant to washing with a weak acid, weak base, ethanol, acetone, water and customary cleaning agents.

The adhesion of the coating to the surface complies with the tape-test requirements.

In a scratch-resistance test in which a conical diamond (radius 8 μm) is moved over the surface with a force of 45 g, it is established that any scratches formed are invisible to the naked eye.

The hardness is tested by means of a pencil test, in which pencils of different hardnesses to which a force of 7.5N is applied are moved over the surface of the layer at an angle of 45° and a rate of 0.05 m/s. According to this test, the coating in accordance with the invention has a degree of hardness in the range from 7 H to 8 H.

The abrasion resistance of the coating is determined by rubbing the same surface of the layer twenty times over a length of 25 mm with a Lion 50-50 eraser with a force of 10N. The outcome of the test is that any scratches on the rubbed surface are invisible to the naked eye.

The light fastness of the coating is tested by means of the so-called Xeno test in accordance with DIN-standards 54003 and 54004, using a Heraeus Sun test CPS apparatus. In this test, the coating is exposed to artificial light corresponding to daylight under indoor conditions, in such a manner that a residence time of the filtering layer of 24 hours in this apparatus corresponds to 1 year of indoor conditions as tested according to DIN-wool standards. After an exposure time corresponding to 4 years of indoor use (DIN-wool scale 6) the transmission of the layer has increased by 10% only.

Exemplary embodiment 2.

The FIGURE is a diagrammatic, cut-away view of a cathode ray tube 1 which is known per se and which has a glass envelope 2 comprising a display screen 3, a cone 4 and a neck 5. In the neck there is provided an electron gun 6 for generating an electron beam. This electron beam is focused on a phosphor layer on the inside 7 of the display screen 3. The electron beam is deflected across the display screen in two mutually perpendicular directions by means of a deflection coil system. The display screen 3 is provided on the outside with a light-absorbing coating 8 in accordance with the invention.

The invention enables light-absorbing coatings having a thickness of at least 0.5 μm and having a low transmission to be provided on a display screen of a display device in a simple manner. These relatively thick layers do not exhibit crackles. A high-polish coating can be obtained even if, prior to the application of the coating, the display screen has a matt appearance with an average roughness $R_a$ of 0.13 μm. The average roughness $R_a$ of the coated display screen is 0.03 μm. The coatings are lightfast and resistant to customary cleaning liquids. Curing of the filtering layer at 160° C., to which temperature display tubes are resistant, results in scratch-resistant and wear-resistant layers.

I claim:

1. A display device having a glass envelope comprising a cone, a neck, and a display screen, an electron gun inside the neck and a phosphor layer on the inside of the screen, the display screen also provided with a light-absorbing coating of an inorganic network comprising at least silicon oxide and a dyestuff, characterized in that a metal oxide of at least one metal selected from the group formed by Al, Ti, Zr and Ge is incorporated into the network, and in that the coating also comprises a carbon-containing polymer which is chemically bonded to the inorganic network via Si—C bonds.

2. A display device as claimed in claim 1, characterized in that the thickness of the coating is 0.8 to 10 μm.

3. A display device as claimed in claim 1, characterized in that the coating comprises 5 to 35 mol % aluminium relative to silicon.

4. A display device as claimed in claim 1, characterized in that the polymer is selected from the group formed by polyether, polyacrylate and polyvinyl.

5. A display device as claimed in claim 1, characterized in that the black dyestuff with Colour Index Solvent Black 28 is used as the dyestuff.

6. A method of manufacturing a light-absorbing coating of an inorganic network of at least silicon oxide on a display screen of a display device by means of a sol-gel process, in which an aqueous solution of an alkoxysilane and a dyestuff is provided on the display screen and heated to convert the solution into said coating, characterized in that the solution comprises a mixture of a trialkoxysilane of the formula:

$$(RO)_3Si—R^1$$

wherein R is an alkyl group and $R^1$ is a polymerizable group, and in which $R^1$ is chemically bonded to the Si-atom via a Si—C bond, an alkoxy compound of at least one metal selected from the group formed by Al, Ti, Zr and Ge, and the dyestuff, the thermal treatment being carried out to form the dyestuff-containing coating from the inorganic network of silicon oxide comprising an oxide of the metal and a polymer which is formed from the polymerizable $R^1$-group, which polymer is chemically bonded to and intertwined with the inorganic network via Si—C bonds.

7. A method as claimed in claim 6, characterized in that the polymerizable group is selected from the group formed by epoxy, methacryloxy and vinyl.

8. A method as claimed in claim 6, characterized in that trialkoxyaluminate is used as the metal alkoxy compound.

9. A method as claimed in claim 6, characterized in that the black dyestuff with Colour Index Solvent Black 28 is used as the dyestuff.

10. A method as claimed in claim 6, characterized in that the solution also comprises 40 mol % alkyl trialkoxysilane or aryl trialkoxysilane relative to the other alkoxy compounds.

11. A method as claimed in claim 6, characterized in that the solution also comprises 1 mol % of a fluorocarbon silane relative to the other alkoxy compounds.

12. A method as claimed in claim 6, characterized in that the solution comprises the following constituents:

alkoxy compounds in the following molar percentages:

40 to 90 mol % 3-glycidoxypropyl-trimethoxysilane 5 to 35 mol % tributoxy-aluminate 0.01 to 10 mol % 3-aminopropyl-triethoxysilane 0 to 30 mol % phenyl-trimethoxysilane 1 to 10 wt. % of the black dyestuff with Colour Index Solvent Black 28 an organic solvent water.

13. A method as claimed in claim 6, characterized in that the solution is spin coated onto the display screen.

* * * * *